US009462925B2

(12) United States Patent
Boyer

(10) Patent No.: US 9,462,925 B2
(45) Date of Patent: Oct. 11, 2016

(54) SPRAY ASSEMBLY FOR A DISHWASHER APPLIANCE

(71) Applicant: General Electric Company, Schenectady, NY (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 909 days.

(21) Appl. No.: 13/736,327

(22) Filed: Jan. 8, 2013

(65) Prior Publication Data

US 2014/0190534 A1 Jul. 10, 2014

(51) Int. Cl.
*A47L 15/42* (2006.01)
*A47L 15/23* (2006.01)

(52) U.S. Cl.
CPC ..... *A47L 15/23* (2013.01); *A47L 15/4282* (2013.01)

(58) Field of Classification Search
CPC ..... A47L 15/18; A47L 15/20; A47L 15/22; A47L 15/23; A47L 15/4282; B08B 3/02; B08B 3/00
See application file for complete search history.

(56) References Cited

U.S. PATENT DOCUMENTS

| | | | | |
|---|---|---|---|---|
| 3,261,554 | A | 7/1966 | Perl | |
| 4,134,414 | A * | 1/1979 | Jarvis | A47L 15/23 134/144 |
| 4,869,428 | A * | 9/1989 | Gombar | B05B 3/06 134/179 |
| 5,660,196 | A * | 8/1997 | Bein | A47L 15/16 134/129 |
| 5,752,533 | A * | 5/1998 | Edwards | A47L 15/23 134/176 |
| 6,305,546 | B1 * | 10/2001 | Saunders | B65D 1/36 206/459.1 |
| 6,357,460 | B1 * | 3/2002 | Bertsch | A47L 15/23 134/174 |
| 2006/0054204 | A1 * | 3/2006 | Fischer | A47L 15/22 134/176 |
| 2010/0251784 | A1 * | 10/2010 | Lee | D06F 23/04 68/200 |
| 2011/0220149 | A1 | 9/2011 | Thiyagarajan | |
| 2014/0110439 | A1 * | 4/2014 | Tada | B65D 41/0471 222/383.1 |

* cited by examiner

*Primary Examiner* — Michael Kornakov
*Assistant Examiner* — Marc Lorenzi
(74) *Attorney, Agent, or Firm* — Dority & Manning, P.A.

(57) ABSTRACT

A spray assembly for a dishwasher appliance is provided. The spray assembly includes a base unit and a mounting bracket rotatably mounted to the base unit. A spray arm is selectively secured to the mounting bracket. The mounting bracket includes features for engaging the spray arm and hindering undesired detachment of the spray arm from the mounting bracket.

17 Claims, 8 Drawing Sheets

SPRAY ASSEMBLY FOR A DISHWASHER APPLIANCE

FIELD OF THE INVENTION

The present subject matter relates generally to dishwasher appliances and spray assemblies for the same.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. The spray assemblies can include a lower spray assembly mounted to the tub at a bottom of the wash compartment, a mid-level spray assembly mounted to one of the rack assemblies, and an upper spray assembly mounted to the tub at a top of the wash compartment.

The spray assemblies can each include spray arms that rotate and direct wash fluid onto articles in the rack assemblies. Generally, such spray arms are mounted to the spray assemblies using fasteners that extend through the spray arm into other components of the spray assemblies or the tub. In alternative designs, the spray arms can be secured onto the spray assemblies using snap fit connections.

Certain spray assemblies are configured to rotate in two directions. Mounting such spray assemblies using fasteners or snap fit connections can be problematic. For example, the fasteners and/or snap fit connectors can work loose over time, particularly when the spray assemblies change direction. Thus, the spray assemblies can disconnect or leak over time due to the attachment mechanism working loose.

Accordingly, a spray assembly for a dishwasher appliance with features for hindering undesired detachment of a spray arm of the spray assembly would be useful. In particular, a spray assembly for a dishwasher appliance with features for rotating in two directions and for hindering undesired detachment of a spray arm of the spray assembly would be useful.

BRIEF DESCRIPTION OF THE INVENTION

The present subject matter provides a spray assembly for a dishwasher appliance. The spray assembly includes a base unit and a mounting bracket rotatably mounted to the base unit. A spray arm is selectively secured to the mounting bracket. The mounting bracket includes features for engaging the spray arm and hindering undesired detachment of the spray arm from the mounting bracket. Additional aspects and advantages of the invention will be set forth in part in the following description, or may be apparent from the description, or may be learned through practice of the invention.

In a first exemplary embodiment, a spray assembly for a dishwasher appliance is provided. The spray assembly defines an axial direction, a radial direction, and a circumferential direction. The spray assembly includes a base unit that defines an inlet for receipt of wash fluid and an outlet. A mounting bracket is rotatably mounted to the base unit. The mounting bracket includes an annular sidewall that has an inner surface and an outer surface. The annular sidewall also defines a plurality channels. A post is mounted to the annular sidewall and extends away from the outer surface of the annular sidewall. The post has an upper surface. A tab is mounted on the upper surface of the post. A spray arm is selectively secured to the mounting bracket. The spray arm includes a main body that defines a chamber configured for receipt of wash fluid from the outlet of the base unit. The main body also has a bottom surface that faces the mounting bracket. The main body defines a detent on the bottom surface of the main body. The detent receives the tab of the mounting bracket. A circular sidewall is mounted to the main body and extends away from the bottom surface of the main body. A plurality of projections is mounted to the circular sidewall. Each projection of the plurality of projections is received within a respective channel of the plurality of channels of the annular sidewall.

In a second exemplary embodiment, a dishwasher appliance is provided. The dishwasher appliance includes a tub that defines a wash compartment. A rack assembly is mounted within the wash compartment of the tub and is configured for receipt of articles for washing. The dishwasher appliance also includes a spray assembly for applying wash fluid to articles within the rack assembly. The spray assembly defines an axial direction, a radial direction, and a circumferential direction. The spray assembly includes a base unit mounted to the tub. The base unit defines an inlet for receipt of wash fluid and an outlet. A mounting bracket is rotatably mounted to the base unit. The mounting bracket includes an annular sidewall that has an inner surface and an outer surface. The annular sidewall also defines a plurality channels. A post is mounted to the annular sidewall and extends away from the outer surface of the annular sidewall. The post has an upper surface. A tab is mounted on the upper surface of the post. A spray arm is selectively secured to the mounting bracket. The spray arm includes a main body that defines a chamber configured for receipt of wash fluid from the outlet of the base unit. The main body also has a bottom surface that faces the mounting bracket. The main body defines a detent on the bottom surface of the main body. The detent receives the tab of the mounting bracket. A circular sidewall is mounted to the main body and extending away from the bottom surface of the main body. A plurality of projections is mounted to the circular sidewall. Each projection of the plurality of projections is received within a respective channel of the plurality of channels of the annular sidewall.

In a third exemplary embodiment, a spray assembly for a dishwasher appliance is provided. The spray assembly defines an axial direction, a radial direction, and a circumferential direction. The spray assembly includes a base unit that defines an inlet for receipt of wash fluid and an outlet. A mounting bracket is rotatably mounted to the base unit. The spray assembly also includes a spray arm that defines a chamber configured for receipt of wash fluid from the outlet of the base unit. A plurality of radial tabs is mounted to the mounting bracket or the spray arm. The plurality of radial tabs is oriented in the radial direction such that the plurality of radial tabs projects along the radial direction. A plurality of radial slots is defined by the mounting bracket or the spray arm. The plurality of radial tabs is received by the plurality of radial slots. A plurality of axial tabs is mounted to the mounting bracket or the spray arm. The plurality of axial tabs is oriented in the axial direction such that the plurality of axial tabs projects along the axial direction. A plurality of axial slots is defined by the mounting bracket or the spray arm. The plurality of axial tabs is received by the plurality of axial slots. The spray arm is selectively secured to the mounting bracket with the plurality of radial tabs and the plurality of axial tabs such that one of the plurality of radial tabs and the plurality of axial tabs hinders relative rotation in a clockwise direction and the other hinders relative rotation in a counterclockwise direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
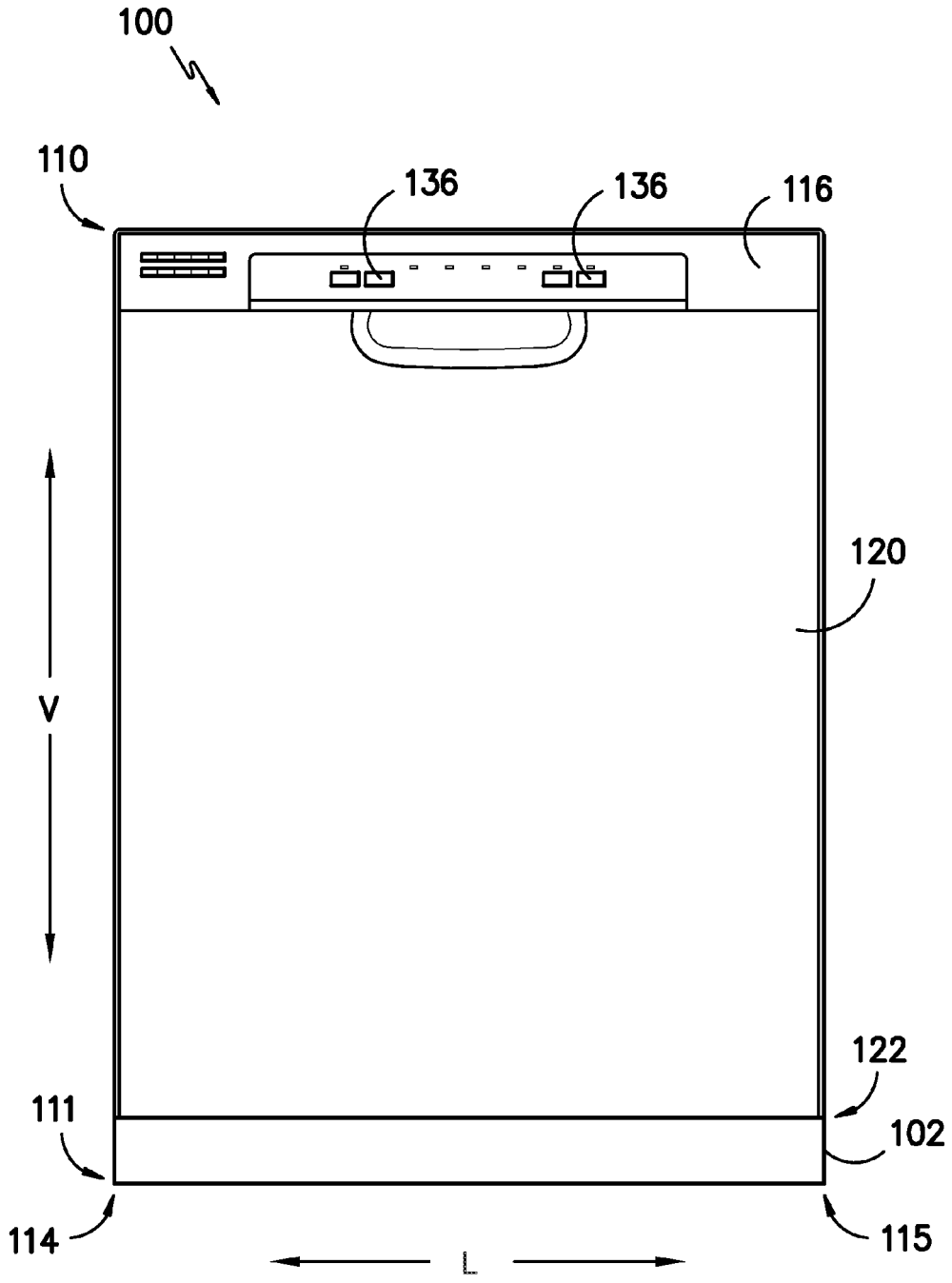
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
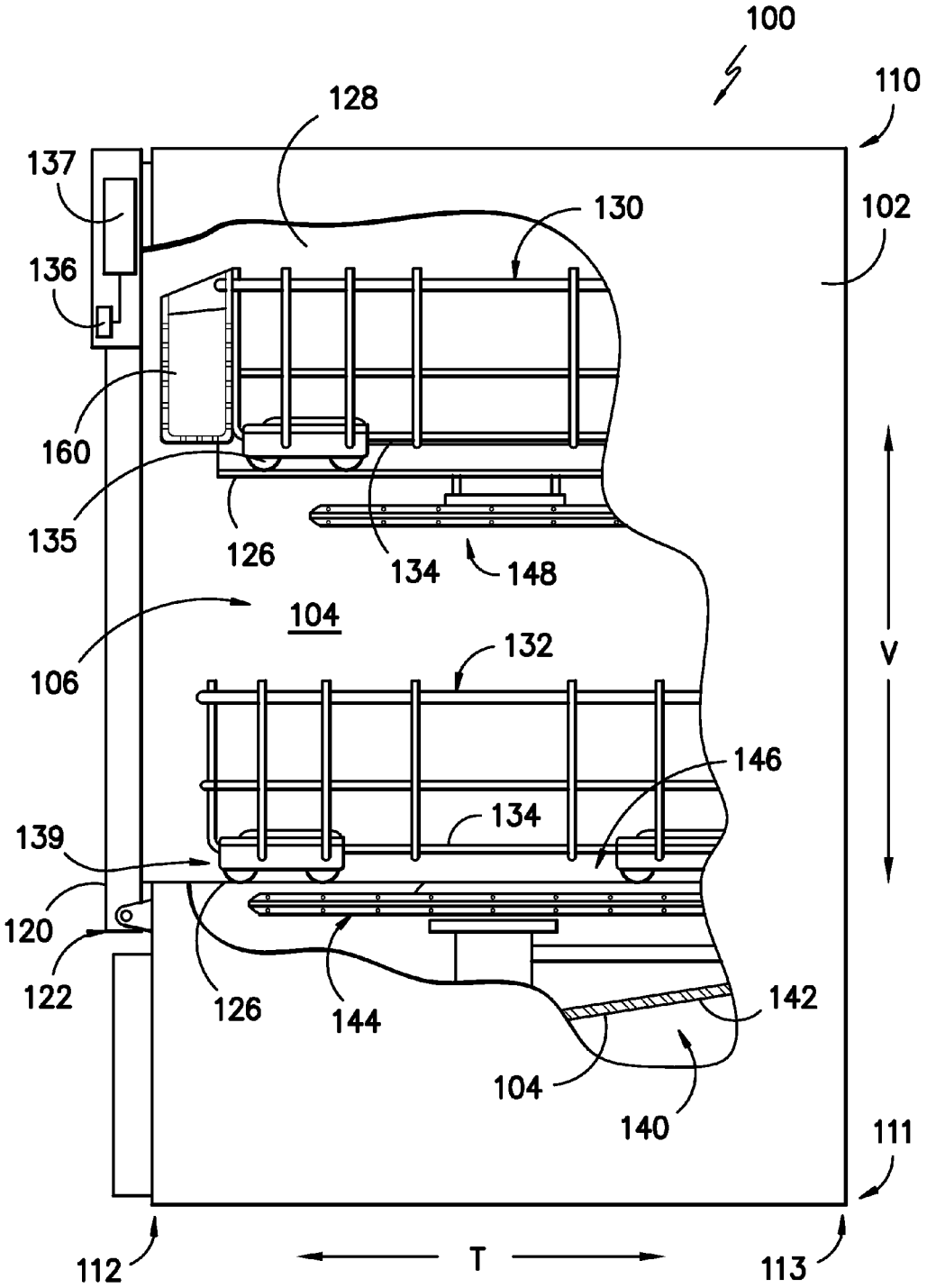
FIG. 2 illustrates a section view of the dishwasher appliance of FIG. 1.

FIGS. 1 and 2 depict a dishwasher appliance 100 according to an exemplary embodiment of the present subject matter. The dishwasher appliance 100 includes a cabinet 102 having a tub 104 therein that defines a wash compartment 106. Tub 104 also includes a door 120 hinged at its bottom 122 for movement between a normally closed configuration (shown in FIGS. 1 and 2) in which wash compartment 106 is sealed shut, e.g., for washing operation, and an open configuration, e.g., for loading and unloading of articles from dishwasher appliance 100.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

Turning to FIG. 2, guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash compartment 106, and a retracted position (shown in FIGS. 1 and 2) in which the rack is located inside the wash compartment 106.

A silverware basket 160 is removably mounted to upper rack assembly 130. However, silverware basket 160 may also be selectively attached to other portions of dishwasher appliance 100, e.g., lower rack 132 or door 120. Silverware rack 160 is configured for receipt of silverware, utensils, and the like, that are too small to be accommodated by the upper and lower racks 130, 132.

The dishwasher appliance 100 further includes a lower spray assembly 144 that is mounted within a lower region 146 of the wash compartment 106 and above a tub sump portion 142 so as to be in relatively close proximity to the lower rack 132. A mid-level spray assembly 148 is located in an upper region of the wash compartment 106 and may be located in close proximity to upper rack 130. Additionally, an upper spray assembly (not shown) may be located above the upper rack 130. The lower and mid-level spray assemblies 144, 148 and the upper spray assembly are fed by a fluid circulation assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art.

Each spray assembly includes an arrangement of discharge ports or orifices for directing washing liquid onto dishes or other articles located in the upper and lower racks 130, 132 and silverware basket 160. The lower and mid-level spray assemblies 144, 148 may be rotatably mounted in wash compartment 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 116 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

Figure 3:
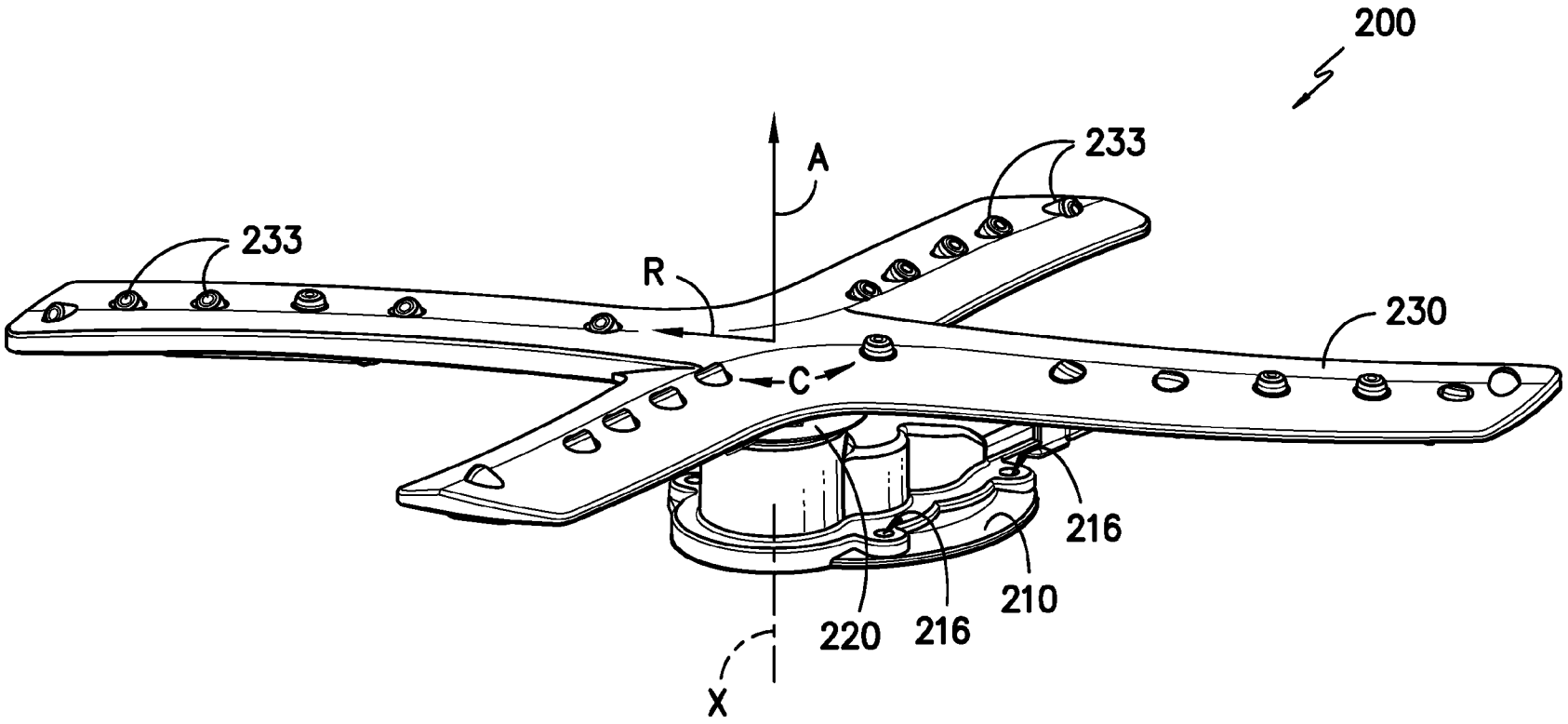
FIG. 3 provides a perspective view of a spray assembly according to an exemplary embodiment of the present subject matter and as may be used in the dishwasher washer appliance of FIG. 1.
Figure 4:
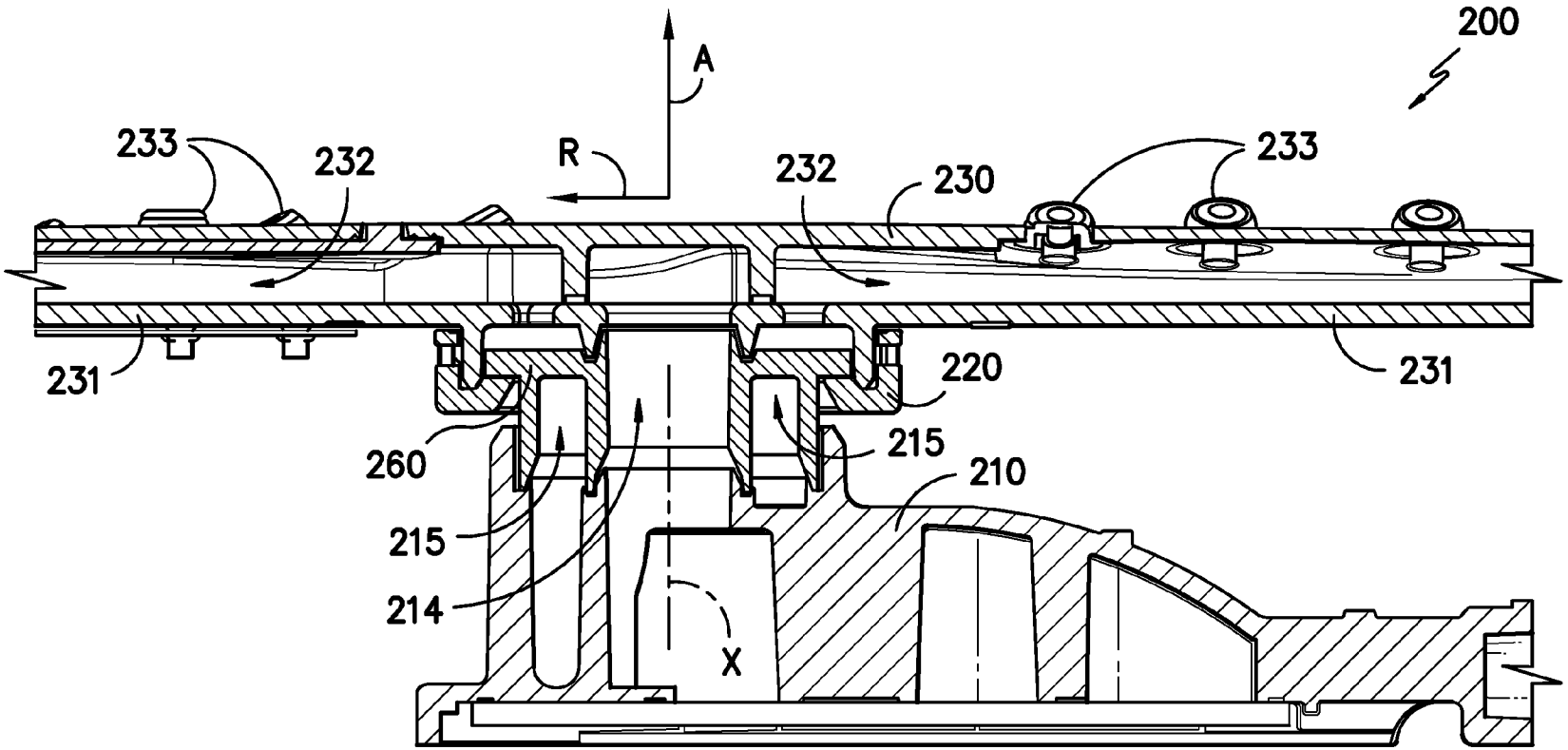
FIG. 4 provides a sectional view of the spray assembly of FIG. 3.

FIG. 3 provides a perspective view of a spray assembly 200 according to an exemplary embodiment of the present subject matter. FIG. 4 provides a sectional view of spray assembly 200. Spray assembly 200 may be used in dishwasher washer appliance 100, e.g., as lower spray assembly 144.

Spray assembly 200 includes a base unit 210. Base unit 210 may be mounted or secured to tub 104, e.g., at tub sump portion 142, or any other suitable component of dishwasher appliance 100. In particular, base unit 210 defines mounting holes 216. Fasteners (not shown) such as screws or bolts may be inserted through mounting holes 216 in order to mount base unit 210 within wash compartment 106 of dishwasher appliance 100.

A spray arm 230 is rotatably mounted to base unit 210 with a mounting bracket 220. Turning to FIG. 4, spray arm 230 includes a main body 231 that defines a chamber 232. Chamber 232 is configured for receipt of wash fluid during operation of dishwasher appliance 100 (FIG. 1). Main body 231 also includes a plurality of nozzles 233 that are in fluid communication with chamber 232 such that wash fluid within chamber 232 flows out of chamber 232 through plurality of nozzles 233. Plurality of nozzles 233 is configured to direct such wash fluid towards articles disposed within upper and lower rack assemblies 130 and 132 and/or silverware basket 150. Further, each nozzle of plurality of nozzles 233 can be directed in a particular direction to facilitate uniform distribution of wash fluid within wash compartment 106.

Figure 5:
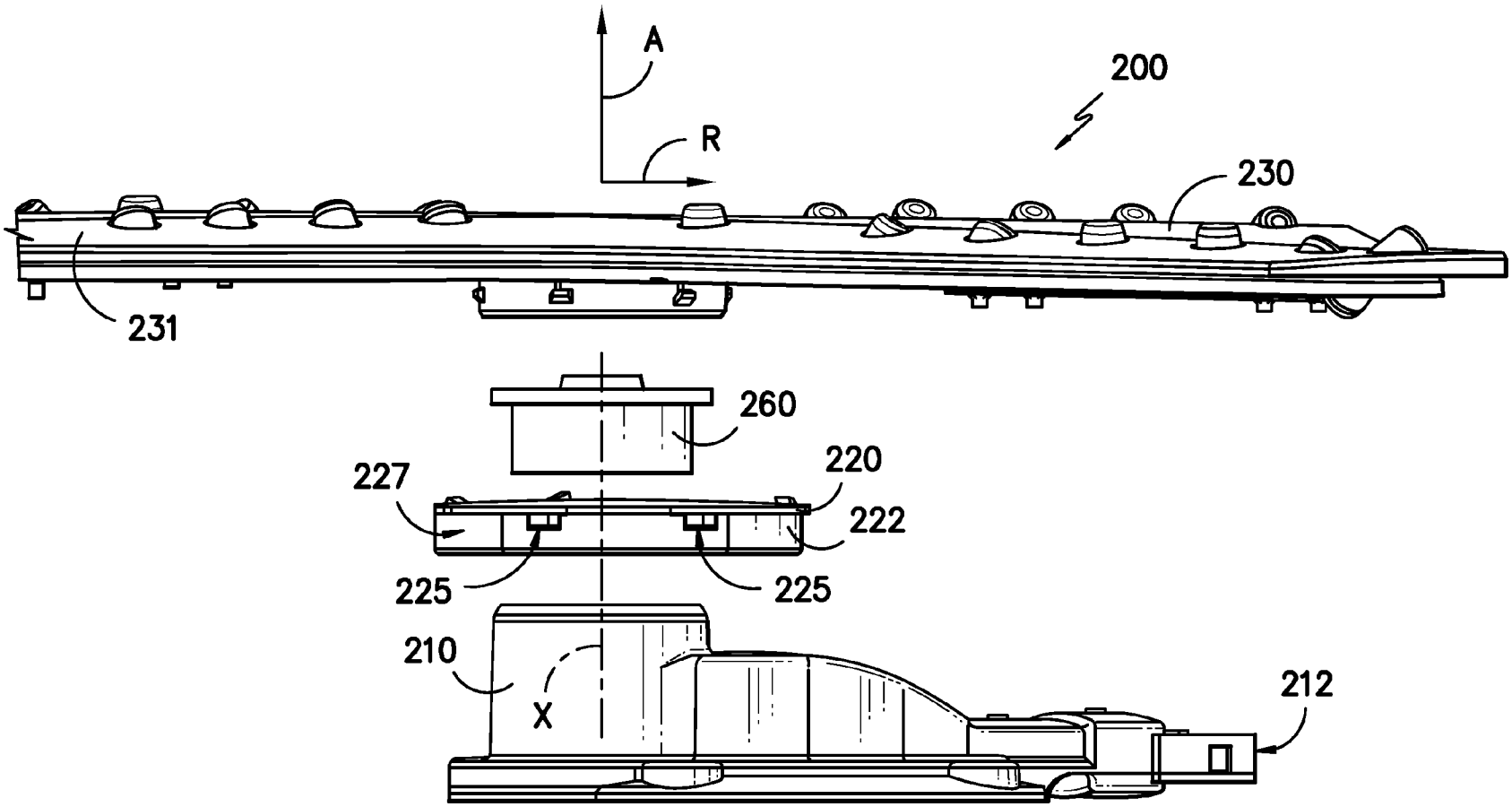
FIG. 5 illustrates an exploded view of the spray assembly of FIG. 3.
Figure 6:
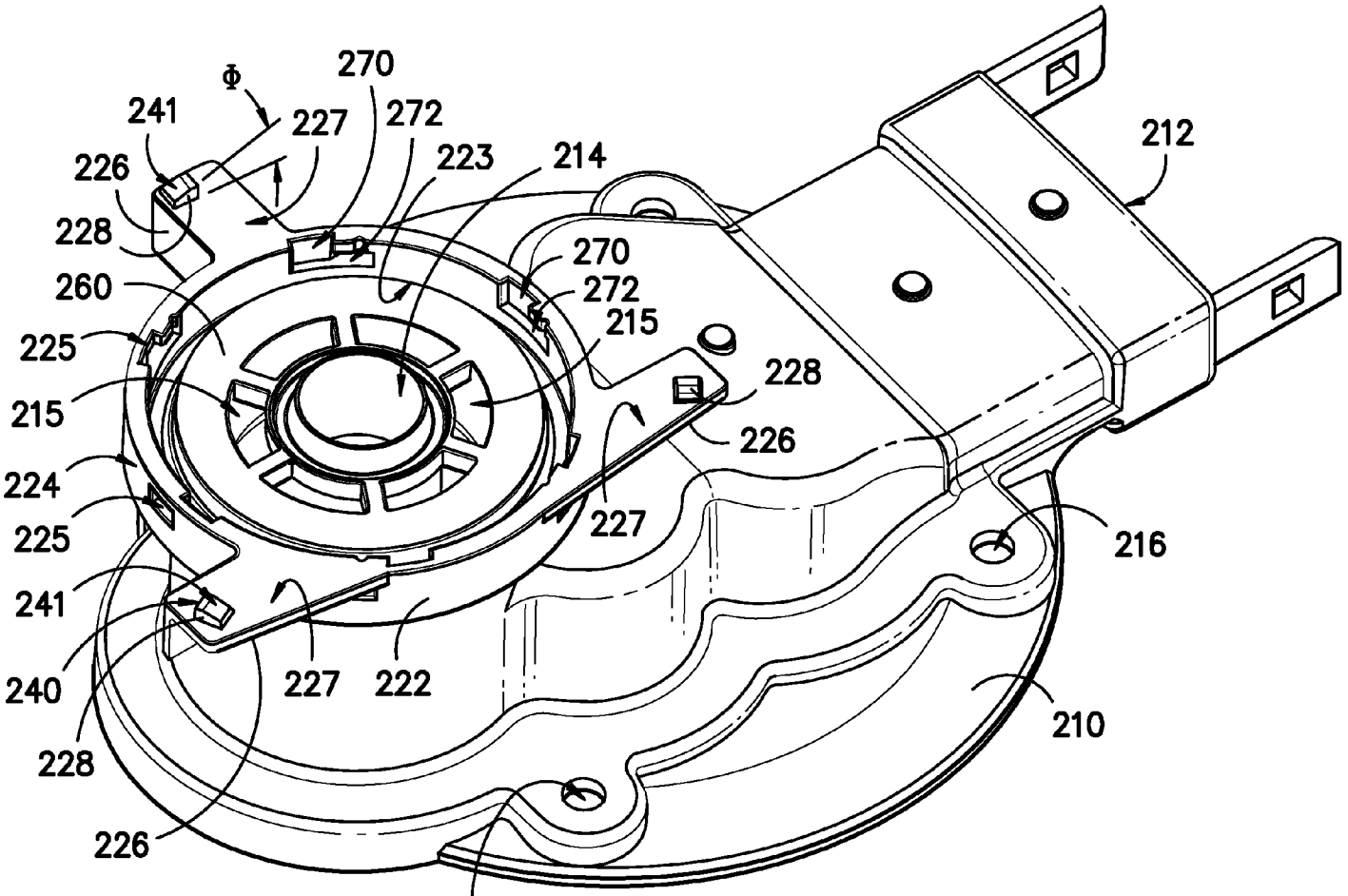
FIG. 6 is a top, perspective view of the spray assembly of FIG. 3 with a spray arm of the spray assembly removed to reveal a base unit according to an exemplary embodiment of the present subject matter and a mounting bracket according to an exemplary embodiment of the present subject matter rotatably mounted to the base unit. The mounting bracket includes a plurality of posts each having a tab mounted thereon.

FIG. 5 illustrates an exploded view of spray assembly 200. FIG. 6 is a top, perspective view of spray assembly 200 with spray arm 230 removed from base unit 210 and mounting bracket 220. Base unit 210 defines an inlet 212 that may be connected to the fluid circulation assembly of dishwasher appliance 100 (FIG. 1). Thus, inlet 212 of base unit 210 can receive wash fluid during operation of dishwasher appliance 100 and direct such wash fluid to spray arm 230.

In particular, base unit 210 of spray assembly 200 includes a manifold 260 that is fixed to base unit 210. Manifold 260 secures mounting bracket 220 to base unit 210 such that mounting bracket 220 is rotatable about and axis of rotation X and manifold 260 and is also configured for rotation relative to base unit 210. Turning to FIG. 6, manifold 260 also defines an outlet 214 and an additional outlet 215. Outlet 214 and additional outlet 215 are in fluid communication with inlet 212 of base unit 210, and wash fluid is directed through base unit 210 from inlet 212 to outlet 214 and/or additional outlet 215 depending upon the direction of rotation desired for spray arm 230 as discussed in greater detail below.

Mounting bracket 220 includes an annular sidewall 222 that has an inner surface 223 (FIG. 6) and an outer surface 224. Annular sidewall 222 also defines a plurality of channels or radial slots 225. In the exemplary embodiment shown in FIG. 6, annular sidewall 222 defines six channels. However, in alternative exemplary embodiments, annular sidewall 222 may define any suitable number of channels, e.g., two, three, four, five, seven, or more channels. In the exemplary embodiment shown in FIG. 6, each channel of plurality of channels 225 extends through annular sidewall 222 from inner surface 223 to outer surface 224. Further, each channel of plurality of channels 225 includes an axial portion 270 that extends along the axial direction A and a circumferential portion 272 that extends along the circumferential direction C. Plurality of channels 225 are configured for assisting with mounting of spray arm 230 to base unit 210 as discussed in greater detail below.

A plurality of posts 226 is mounted to annular sidewall 222 and extends away from outer surface 224 of annular sidewall 222, e.g., along the radial direction R. In the exemplary embodiment shown in FIG. 6, three posts are mounted to annular sidewall 222. However, in alternative exemplary embodiments, only a single post may be mounted to annular sidewall 222 or any suitable number of posts may be mounted to annular sidewall 222, e.g., two, four, five, or more posts. In the exemplary embodiment shown in FIG. 6, posts of plurality of posts 226 are non-uniformly distributed about the circumferential direction C. Each post of plurality of posts 226 has an upper surface 227.

A tab or annular tab 228 is mounted on upper surface 227 of each post of plurality of posts 226. Tab 228 extends away from upper surface 227 of each post of plurality of posts 226, e.g., along the axial direction A. Each tab 228 has an engagement surface 240. Engagement surface 240 may be substantially perpendicular to upper surface 227. Each tab 228 also has a sloped surface 241. Tab 228 defines an angle $\phi$ between sloped surface 241 and upper surface 227. Angle $\phi$ may be any suitable angle. For example, angle $\phi$ may be between about fifty degrees and about ten degrees, between about forty degrees and about twenty degrees, or between about sixty degrees and about twenty degrees.

Figure 7:
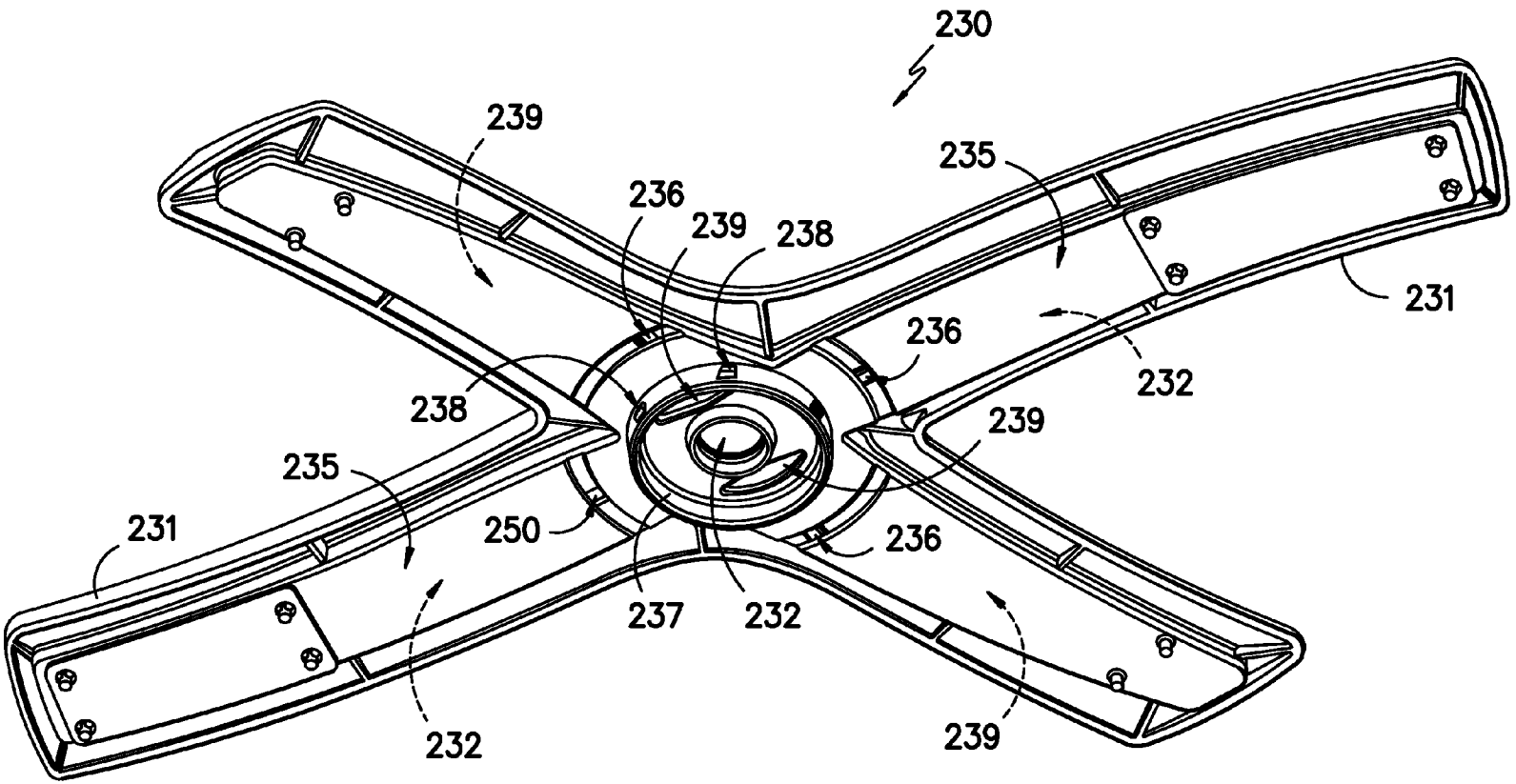
FIG. 7 provides a bottom, perspective view of the spray arm of the spray assembly of FIG. 3. The spray arm defines a plurality of detents on a bottom surface of the spray arm.

FIG. 7 provides a bottom, perspective view of spray arm 230. As discussed above, wash fluid can be directed out of either outlet 214 or additional outlet 215 of manifold 260 (FIG. 6). Chamber 232 of spray arm 230 is configured for receipt of wash fluid from outlet 214. Conversely, main body 231 of spray arm 230 also defines an additional chamber 239 that is configured for receipt of wash fluid from additional outlet 215. During operation of dishwasher appliance 100, spray arm 230 rotates in a first direction when wash fluid is directed into chamber 232 of spray arm 230, and spray arm 230 rotates in a second direction when wash fluid is directed into additional chamber 239 of spray arm 230. The first direction is opposite to the second direction, e.g., the first direction may be clockwise and the second direction may be counter-clockwise or vice versa.

Main body 231 has a bottom surface 235 that faces mounting bracket 220 and/or base unit 210 when spray arm 230 is mounted to mounting bracket 220 and/or base unit 210. Main body 231 also defines a plurality of detents or axial slots 236 on bottom surface 235 of main body 231. In the exemplary embodiment shown in FIG. 7, main body 231 defines four detents. However, in alternative exemplary embodiments, main body 231 may define any suitable number of detents, e.g., one, two, three, five, or more detents. Main body 231 may also include an engagement surface 250 positioned within each detent of plurality of detents 236 that, e.g., is substantially parallel to and positioned adjacent engagement surface 240 of tab 228 when spray arm 230 is secured to mounting bracket 220. Plurality of detents 236 is configured for receipt of tab 228 of mounting bracket 220 in order to assist in mounting spray arm 230 to mounting bracket 220 and/or hinder undesired detachment of spray arm 230 from mounting bracket 220 as discussed in greater detail below.

Spray arm 230 also includes a circular sidewall 237 that is mounted to main body 231 and extends away from bottom surface 235 of main body 231, e.g., downwardly along the axial direction A. A plurality of projections or radial tabs 238 is mounted to circular sidewall 237. Each projection of plurality of projections 238 extends away from circular sidewall 237, e.g., along the radial direction R. Further, each projection of plurality of projections 238 is configured for receipt within a respective channel of plurality of channels 225 of annular sidewall 222.

To mount spray arm 230 to mounting bracket 220, circular sidewall 237 of spray arm 230 may positioned against inner surface 223 of annular sidewall 222 and each projection of plurality of projections 238 may be received within a respective axial portion 270 of plurality of channels 225 (FIG. 6). Spray arm 230 may then be rotated relative to mounting bracket 220 such that each projection of plurality of projections 238 shifts from axial portion 270 of plurality of channels 225 to circumferential portion 272 of plurality of channels 225 (FIG. 6). As spray arm 230 is rotated, at least one tab 228 of mounting bracket 220 (FIG. 6) may also be received within one of plurality of detents 236.

Figure 8:
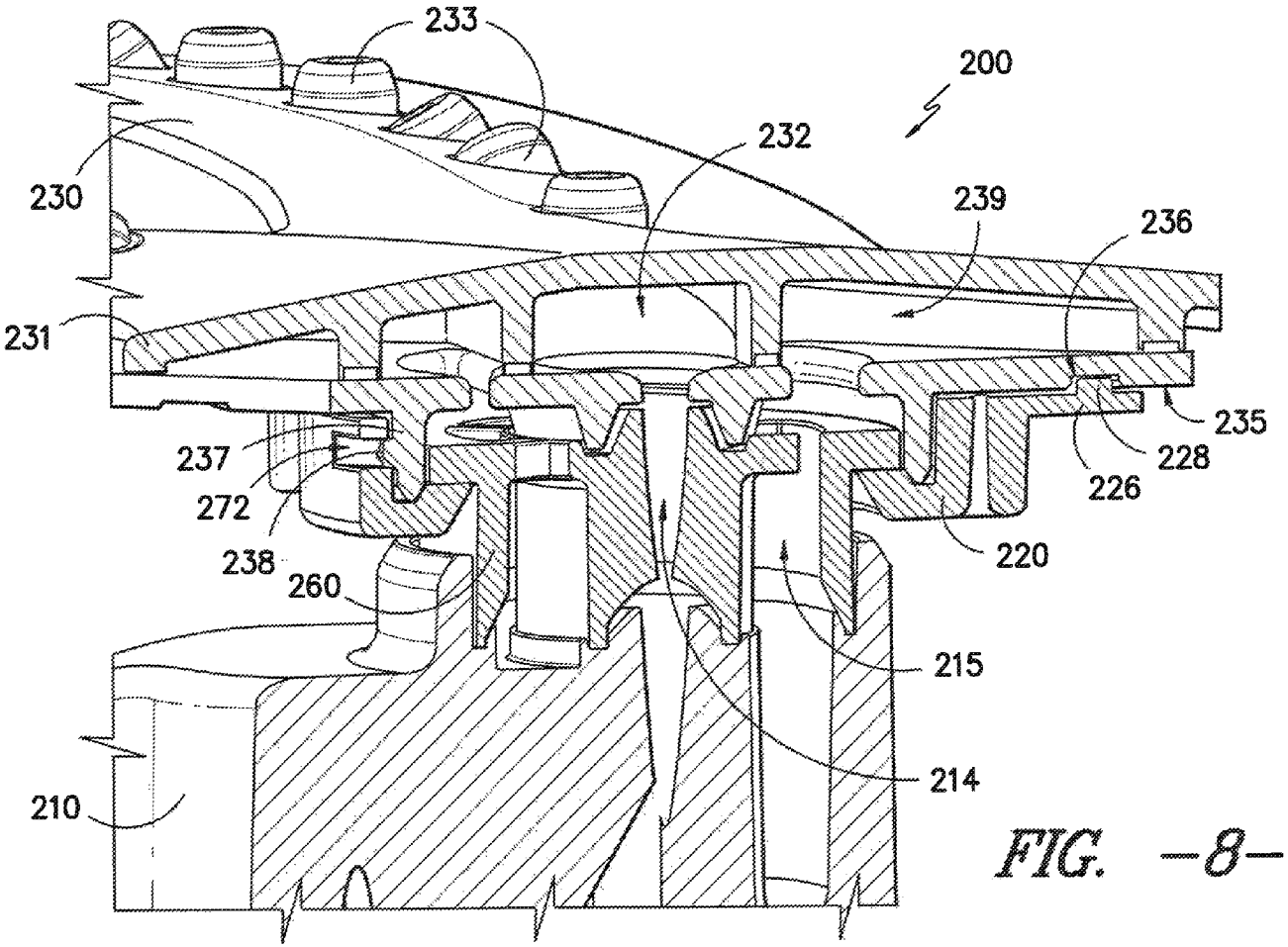
FIG. 8 illustrates a partial, sectional view of the spray assembly of FIG. 3. A tab of the mounting bracket is received within a detent of the spray arm in order to assist with hindering undesired detachment of the spray arm from the mounting bracket.

FIG. 8 illustrates a partial, sectional view of spray assembly 200 with spray arm 230 mounted to mounting bracket 220. In FIG. 8, one of plurality of projections 238 is positioned within circumferential portion 272 of plurality of channels 225 and tab 228 of mounting bracket 220 is received within one of plurality of detents 236. As an example, plurality of projections 238 can hinder undesired rotation of spray arm 230 relative to mounting bracket 220 in a first direction (e.g., a clockwise direction), and tab 228 can hinder undesired rotation of spray arm 230 relative to mounting bracket 220 in a second direction that is opposite to the first direction (e.g., a counter-clockwise direction). Thus, plurality of projections 238 and tab 228 can assist with hindering undesired detachment of spray arm 230 from mounting bracket 220 by hindering rotation of spray arm 230 relative to mounting bracket 220 in both the first and second directions. In particular, without tab 228 disposed within one of plurality of detents 236, spray arm 230 could rotate in the second direction relative to mounting bracket 220, and such could cause spray assembly 200 to leak or cause spray arm 230 to work loose and detach from mounting bracket 220 over time.

In order to remove spray arm 230 from mounting bracket 220, each post of plurality of posts 226 is downwardly deflectable, e.g., along the axial direction A. Thus, to remove spray arm 230 from mounting bracket 220, post 226 may be deflected downwardly in order to remove tab 228 from detent 236. Spray arm 230 may then be rotated relative to mounting bracket 220 such that each projection of plurality of projections 238 shifts from circumferential portion 272 of plurality of channels 225 to axial portion 270 of plurality of channels 225. Spray arm 230 may then be lifted upwardly, e.g., along the axial direction A, to remove plurality of projections 238 from plurality of channels 225 and spray arm 230 from mounting bracket 220.

It should be understood that the exemplary embodiment of spray assembly 200 shown in FIGS. 3-8 is provided by way of example only. In alternative exemplary embodiments, plurality of projections 238 may be mounted to annular sidewall 222 (e.g., on inner or outer surface 223 or 224 of annular sidewall 222) and plurality of channels 225 may be defined in circular sidewall 237. Similarly, tabs 228 may be mounted to spray arm 230 (e.g., on bottom surface 235 of main body 231) and plurality of detents 236 may be defined by plurality of posts 226 (e.g., on upper surface 227 of plurality of posts 226).

Turning back to FIG. 7, plurality of detents 236 is uniformly distributed on bottom surface 235 of main body 231 about the circumferential direction C. However, as discussed above, posts of plurality of posts 226 are non-uniformly distributed about the circumferential direction C. Thus, only one tab 228 is received within one of plurality of detents 236 when spray arm 230 is mounted to mounting bracket 220 as shown in FIG. 8. However, in alternative exemplary embodiments, multiple tabs 228 may be received within respective detents of plurality of detents 236 when spray arm 230 is mounted to mounting bracket 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray assembly for a dishwasher appliance, the spray assembly defining an axial direction, a radial direction, and a circumferential direction, the spray assembly comprising:
- a base unit defining an inlet for receipt of wash fluid and an outlet;
- a mounting bracket rotatably mounted to said base unit, said mounting bracket comprising:
  - an annular sidewall that has an inner surface and an outer surface, the annular sidewall also defining a plurality channels;
  - a post mounted to the annular sidewall and extending away from the outer surface of the annular sidewall, the post having an upper surface; and
  - a tab mounted on the upper surface of the post; and
- a spray arm selectively secured to said mounting bracket, said spray arm comprising:

a main body that defines a chamber configured for receipt of wash fluid from the outlet of said base unit, the main body also having a bottom surface that faces said mounting bracket, the main body defining a detent on the bottom surface of the main body, the detent receiving the tab of said mounting bracket;

a circular sidewall mounted to the main body and extending away from the bottom surface of the main body; and a plurality of projections mounted to the circular sidewall, each projection of the plurality of projections received within a respective channel of the plurality of channels of the annular sidewall;

wherein said base unit defines an additional outlet and the main body of said spray arm defines an additional chamber configured for receipt of wash fluid from the additional outlet of said base unit;

wherein said spray arm rotates in a first direction when wash fluid is directed into the chamber of said spray arm and said spray arm rotates in a second direction when wash fluid is directed into the additional chamber of said spray arm, the first direction being the opposite to the second direction;

wherein said spray arm is secured to said mounting bracket with said projections and said channels and said spray arm is secured to said mounting bracket with said tab and said detent such that said projections and channels hinder relative rotation between the spray arm and the mounting bracket in the first direction and said tab and said detent hinder relative rotation between the spray arm and the mounting bracket in the second direction.

2. The spray assembly of claim 1, wherein the tab includes an engagement surface that is perpendicular the upper surface of the post.

3. The spray assembly of claim 1, wherein the main body of said spray arm includes an engagement surface positioned within the detent, the engagement surface of the main body positioned immediately adjacent the engagement surface of the tab.

4. The spray assembly of claim 1, wherein the tab includes a sloped surface that defines an angle $\phi$ with the upper surface of the post, the angle $\phi$ being between fifty degrees and ten degrees.

5. The spray assembly of claim 1, wherein the post extends away from the outer surface of the annular sidewall by more than one inch.

6. The spray assembly of claim 1, wherein the post is downwardly deflectable in order to permit removal of the tab from the detent.

7. The spray assembly of claim 1, wherein the plurality of channels of the annular sidewall extend through the annular sidewall from the inner surface of the annular sidewall to the outer surface of the annual sidewall.

8. The spray assembly of claim 1, wherein the plurality of projections of said spray arm comprises six projections, the six projections uniformly distributed on the circular sidewall of said spray arm such that each projection of the six projections is spaced apart from adjacent projections by thirty degrees along the circumferential direction.

9. The spray assembly of claim 1, wherein the detent is spaced apart from the circular sidewall of said spray arm by more than one inch along the radial direction.

10. A dishwasher appliance comprising:

a tub that defines a wash compartment;

a rack assembly mounted within the wash compartment of said tub and configured for receipt of articles for washing; and a spray assembly for applying wash fluid to articles within said rack assembly, said spray assembly defining an axial direction, a radial direction, and a circumferential direction, said spray assembly comprising:

a base unit mounted to said tub, said base unit defining an inlet for receipt of wash fluid and an outlet;

a mounting bracket rotatably mounted o said base unit, said mounting bracket comprising:

an annular sidewall that has an inner surface and an outer surface, the annular sidewall also defining a plurality channels;

a post mounted to the annular sidewall and extending away from the outer surface of the annular sidewall, the post having an upper surface; and a tab mounted on the upper surface of the post; and a spray arm selectively secured to said mounting bracket, said spray arm comprising:

a main body that defines a chamber configured for receipt of wash fluid from the outlet of said base unit, the main body also having a bottom surface that faces said mounting bracket, the main body defining a detent on the bottom surface of the main body, the detent receiving the tab of said mounting bracket;

a circular sidewall mounted to the main body and extending away from the bottom surface of the main body;

a plurality of projections mounted to the circular sidewall, each projection of the plurality of projections received within a respective channel of the plurality of channels of the annular sidewall;

wherein said base unit defines an additional outlet and the main body of said spray arm defines an additional chamber configured for receipt of wash fluid from the additional outlet of said base unit;

wherein said spray arm rotates in a first direction when wash fluid is directed into the chamber of said spray arm and said spray arm rotates in a second direction when wash fluid is directed into the additional chamber of said spray arm, the first direction being opposite to the second direction;

wherein said spray arm is secured to said mounting bracket with said projections and channels and said spray arm is secured to said mounting bracket with said tab and said detent such that said projections and channels hinder relative rotation between the spray arm and the mounting bracket in the first direction and said tab and said detent hinder relative rotation between the spray arm and the mounting bracket in the second direction.

11. The dishwasher appliance of claim 10, wherein the tab includes an engagement surface that is perpendicular the upper surface of the post.

12. The dishwasher appliance of claim 10, wherein the main body of said spray arm includes an engagement surface positioned within the detent, the engagement surface of the main body positioned immediately adjacent the engagement surface of the tab.

13. The dishwasher appliance of claim 10, wherein the tab includes a sloped surface that defines an angle $\phi$ with the upper surface of the post, the angle $\phi$ being between fifty degrees and ten degrees.

14. The dishwasher appliance of claim 10, wherein the post extends away from the outer surface of the annular sidewall by more than one inch.

15. The dishwasher appliance of claim 10, wherein the post is downwardly deflectable in order to permit removal of the tab from the detent.

16. The dishwasher appliance of claim 10, wherein the plurality of channels of the annular sidewall extend through the annular sidewall from the inner surface of the annular sidewall to the outer surface of the annual sidewall.

17. The dishwasher appliance of claim 10, wherein the plurality of projections of said spray arm comprises six projections, the six projections uniformly distributed on the circular sidewall of said spray arm such that each projection of the six projections is spaced apart from adjacent projections by thirty degrees along the circumferential direction.

* * * * *